US005490313A

United States Patent [19]

Ashbrook

[11] Patent Number: 5,490,313

[45] Date of Patent: Feb. 13, 1996

[54] BULLET PULLER

[75] Inventor: Clifford L. Ashbrook, Spicewood, Tex.

[73] Assignee: Quinetics Corporation, San Antonio, Tex.

[21] Appl. No.: 178,769

[22] Filed: Jan. 7, 1994

[51] Int. Cl.[6] ..... B25B 27/14

[52] U.S. Cl. ..... 29/275

[58] Field of Search ..... 86/49; 29/275, 29/276, 243, 254, 255, 282; 81/19, 20; 254/26 R; 279/69, 122

[56] References Cited

U.S. PATENT DOCUMENTS

| | | | |
|---|---|---|---|
| 2,682,413 | 6/1954 | Tripp | 279/69 |
| 3,253,329 | 5/1966 | Lehn | 29/275 |
| 3,646,661 | 3/1972 | Ashbrook | 86/49 |
| 5,333,367 | 8/1994 | Ashbrook | 29/275 |

*Primary Examiner*—Robert C. Watson
*Attorney, Agent, or Firm*—Donald R. Comuzzi; Christopher L. Makay

[57] ABSTRACT

An inertial bullet puller comprises a rigid, tough plastics material carrier tube having an opening at its upper end adapted to receive a cartridge and a head portion at its lower end adapted to be struck against a hard surface. The carrier tube is affixed to the end of a handle in a manner similar to the construction of a hammer. The upper end of the carrier tube includes a plurality of slots cut therein to receive an annular segmented support comprised of a plurality of segments interconnected with an O-ring. A cap at the upper end of the carrier tube includes a tapered inner end to provide a cam surface for positively moving the segments radially inward and holding them in position. After a cartridge is inserted through the segments, the cap is tightened to urge the segments inwardly along the slots so that they engage the cannelure and casing of the cartridge. In use the lower end of the tube is struck against a hard surface until the bullet is observed to pull free of the cartridge casing. The lower end of the tube is closed forming a pocket to receive the bullet and casing contents when the bullet is freed from the casing. The cap is then backed off to allow the O-ring to move the segments radially outward which permits the cartridge components to pass from the upper end of the carrier tube when it is inverted and shaken.

8 Claims, 2 Drawing Sheets

BULLET PULLER

BACKGROUND OF THE INVENTION

1. Field of the Invention

The present invention relates to inertial bullet pullers which are devices utilized to remove the bullet from the casing of cartridge type rounds of ammunition. Inertial bullet pullers operate by first imparting a rapid motion to the cartridge and then bringing the casing thereof to a quick stop. When the casing slows down it tries to slow down the bullet too, thereby imposing tension on the connection between the bullet and the casing. If the tension force is great enough, the connection parts which is the desired result. The tension force is proportional to the time rate of change in the momentum of the bullet and for any given bullet mass is proportional to the time rate of change in bullet velocity. The latter depends on the initial velocity of the bullet and upon the length of time required to stop it, which, in turn, depends on the speed of propagation of the elastic shock wave through the material carrying the cartridge casing.

2. Discussion of the Related Art

Inertial bullet pullers presently in use include a rigid cartridge carrier in the form of a transparent, plastics material tube having an opening at one end adapted to receive a cartridge and provided at its other end with a head portion adapted to be struck against a hard surface. A cartridge support is provided at the one end of the carrier tube for engaging the cannelure or other portion of the cartridge casing. The head end of the carrier tube extends beyond the nose of the bullet and is closed with its interior being tapered at the lower end.

In use, a cartridge is placed in the carrier tube and supported therein by the cartridge support which engages the cannelure. A securing cap is provided for holding the cartridge support to the end of the carrier. The head portion at the end of the carrier tube is repeatedly struck against a hard surface such as the top of a table until the bullet pulls free of the casing. To facilitate both the acceleration of the carrier to a high velocity and the striking of it against a fixed hard surface, the carrier connects to a handle extending transversely from the carrier tube. The resulting carrier and handle combination has the overall shape of a hammer.

These bullet pullers presently employ cartridge supports in the form of an open-sided washer which extends from the top of the cartridge carrier to underneath the upper side of the cannelure when the puller is in use. A snug-fitting polyethylene cap is slipped over the upper end of the carrier and frictionally engages the carrier tube and holds the washer and cartridge in place. Such a cartridge support is the source of some difficulty because a plurality of support washers having differing inner diameters must be employed in order to accommodate cartridges having different diameter cannelures. Also, after each use it is necessary to pull the tight-fitting cap off the end of the carrier.

Another form of cartridge support employed by currently available bullet pullers consists of a U-shaped plate which has a variable width between its tines in order to adapt it to cannelures of different diameters. However, such a cartridge support has so little area of engagement with the cannelure that it readily shears if the carrier is struck too hard.

An improvement over the above inertial bullet pullers is disclosed in my U.S. Pat. No. 3,646,661. According to my inertial bullet puller, an annular segmented support is provided at the upper end of the carrier of the bullet puller which is extendable into and retractable from the cannelure of a cartridge placed therein. Additionally, the annular segmented support is configured to fit a wide range of cartridges having cannelures of different diameters. The annular segmented support comprises a plurality of arcuate shape members or segments adapted to be annularly disposed at the upper end of a carrier. A garter spring extends around the segments to provide a resilient force for urging the segments radially inwardly to an extent limited either by engagement with a cartridge or by the otherwise spaced apart sides of the segments coming into engagement. A cam surface is provided for positively urging the segments radially inwardly and holding them positioned beneath the upper wall of a cartridge cannelure. The cam surface is carried by a cap that threadably engages the upper end of the carrier tube adjacent the cannelure.

Although the inertial bullet puller disclosed in my U.S. Pat. No. 3,646,661 improves over existing inertial bullet pullers, it fails to operate as easily and efficiently as desired. That is, once the bullet disengages from the case, it is necessary to remove the securing cap before the bullet may be retrieved from the carrier tube. Although the cartridge support was originally intended to part sufficiently far enough to allow the bullet to pass, it was discovered that no matter how much the carrier tube is shaken or the securing cap rapped against a hard surface, the bullet will not pass and cannot be removed without first removing the securing cap. Thus, the use of the inertial bullet puller disclosed in my U.S. Pat. No. 3,646,661 is both tedious and requires a notable time investment when a significant number of bullets are disengaged from their casings. Such performance characteristics are less than desirable to the ordinary shooting enthusiast.

An improvement over the inertial bullet puller disclosed in my U.S. Pat. No. 3,646,661 is disclosed in my allowed U.S. patent application Ser. No. 07/967,214. That inertial bullet puller improves over standard inertial bullet pullers including my U.S. Pat. No. 3,646,661 by employing a redesigned annular segmented support. A first design of the annular segmented support comprises three segments connected together using a flexible O-ring. The O-ring is permanently affixed to the three segments and then severed at one spot so that it no longer forms a continuous ring. The O-ring is permanently affixed to the plurality of segments in order to keep them all connected together, however, it is split to prevent the segments from being continuously forced radially inward.

The second design comprises two segments, the ends of which are shaved so that they protrude less than the center. For use with rifle cartridges, the two segments are connected together with an O-ring, but for use with pistol cartridges, the O-ring is removed and the two segments are left unconnected. The segment ends are shaved so that uniform pressure in a radially inward direction will be applied to the segment centers by the securing cap as it is threadably attached to the carrier tube. A uniform pressure is necessary to ensure that the segments move squarely as they engage the casing cannelure. Square and uniform movement of the two segments as they engage the casing cannelure allows them to grasp the cannelure along the greatest surface area. If the ends of the segments were not reduced, the segments would engage the cannelure only at their ends, thereby permitting many of the cartridges to pass through the segments after the carrier tube was struck against a hard surface.

Both designs improve over the above-described inertial bullet pullers because they permit the bullet to be extracted after separation from the casing without first having to remove the securing cap attached to the upper end of the carrier tube. The first design allows passage of the bullet because the segment ends which remain unconnected as a result of the severed O-ring open sufficiently far to allow the bullet to pass when the carrier tube is shaken or the securing cap is rapped against a hard surface. Similarly, the second design allows passage of the bullet because due to the use of only two segments there will always be an opening between the two segments, even in their most closed position, which is sufficiently large to allow the bullet to pass when the carrier tube is shaken or the securing cap is rapped against a hard surface.

SUMMARY OF THE INVENTION

In accordance with the present invention, an inertial bullet puller includes a carrier tube which has an opening at its upper end and a closed lower end to provide a head portion for striking against a hard surface. A boss on one side of the carrier tube furnishes a connection point for securing the carrier tube to a shaft fitted with a handgrip to form a handle for the carrier tube.

The upper end of the carrier tube includes an external helical screw thread correlative to an internal helical screw thread of a generally cylindrical cup-shaped screw cap. The upper end of the carrier tube further includes three slots cut therein to receive and hold an annular segmented support. The annular segmented support comprises three segments interconnected by an O-ring. The segments fit within the slots cut into the upper end of the carrier tube to support a cartridge within the carrier tube.

The upper end of the cap has a cylindrical opening or bore which is of slightly larger diameter than cylindrical inner surface of the carrier tube. Furthermore, a cam surface at the upper inner surface of the cap provides a means for positively moving the segments of the annular segmented support radially inward and holding them within the slots. When the cap is screwed down, the cam surface of the cap moves each of the segments inwardly along their respective slot to a position under the upper side of the cannelure of the cartridge so that they fit snugly against the smallest diameter portion of the cannelure. Additionally, the lower portion of the segments engage the portion of the casing directly below the cannelure. The cap then retains the segments in that position on the upper end of the carrier tube so that the inertial bullet puller may be used.

In operation, a user grasps the handle, swings the inertial bullet puller to impart a high speed to the carrier tube, and strikes the head portion at the lower end of the carrier tube against a hard surface. Consequently, a shock wave which traverses through the carrier tube is established as the carrier tube either stops at or rebounds from the hard surface. That resulting shock wave pulls the casing and bullet apart. That is, when the shock wave reaches the annular segmented support, the upwardly moving end of the carrier tube pushes the segments upwardly relative to the cartridge which allows the upper ends of the segments bearing against the upper side of the cannelure to pull the casing from the bullet.

After striking the carrier tube head portion against the hard surface, the bullet falls free of the cartridge casing into the lower part of the carrier tube. The cap is then loosened so that the cam surface is spaced axially from the top surfaces of the segments a sufficient distance to permit the O-ring interconnecting the segments to expand the segments along their respective slots. The carrier tube is inverted and the cartridge casing, the bullet, and powder are shaken out of the carrier tube. The segments expand amply enough to allow even the largest caliber bullets to be removed without first completely detaching the cap because the O-ring forces them completely from the opening at the upper end of the carrier tube.

It is, therefore, an object of the present invention to provide an inertial bullet puller with an annular segmented support which allows a bullet separated from its casing to be removed from the carrier tube without first having to remove the securing cap.

Still other objects, features, and advantages of the present invention will become evident to those skilled in the art in light of the following.

DETAILED DESCRIPTION OF THE PREFERRED EMBODIMENT

Figures 1, 2, 3, 4, 5:
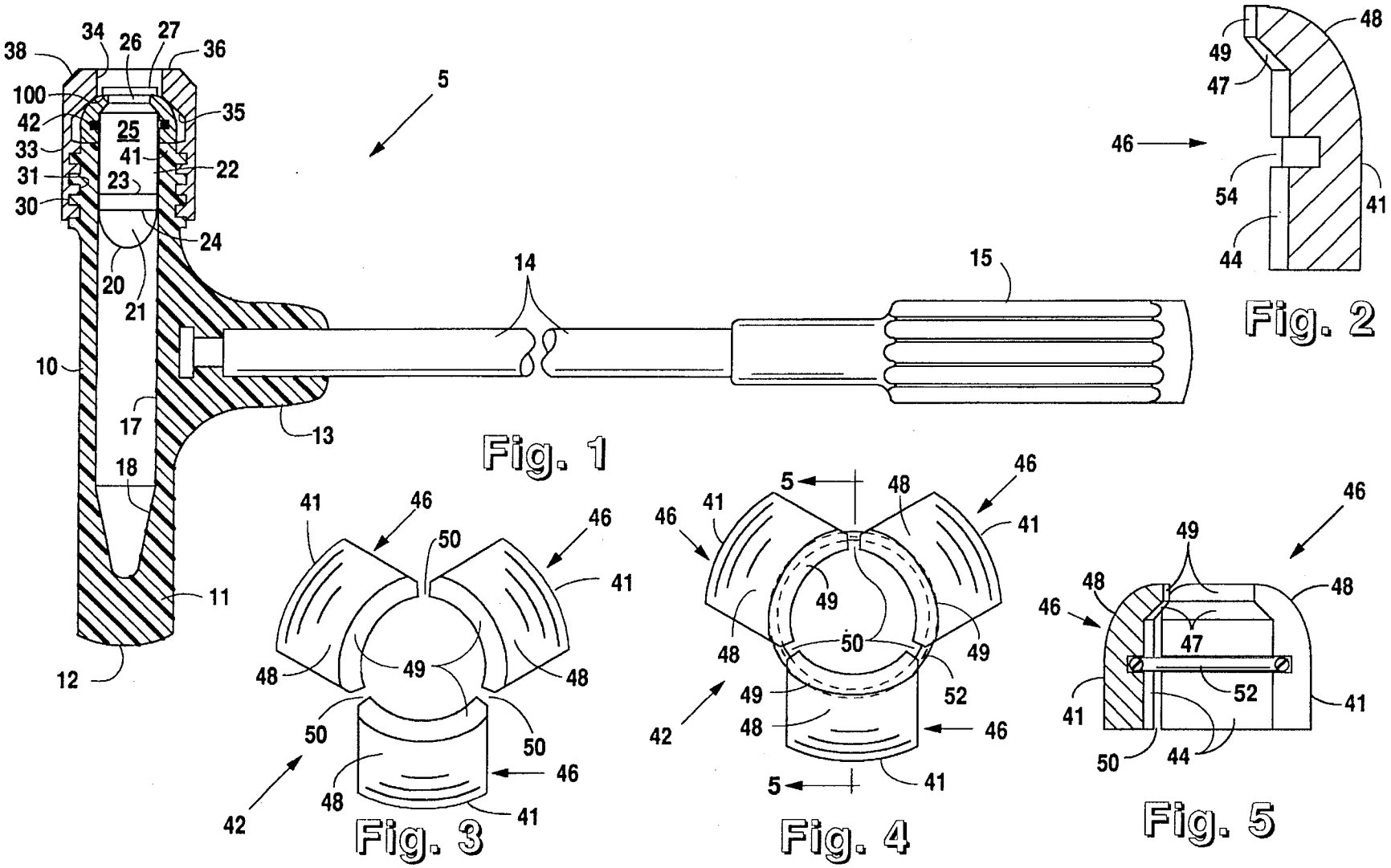
FIG. 1 is a side elevation view in partial cross-section depicting the inertial bullet puller of the present invention.
FIG. 2 is a side elevation view in cross-section depicting one segment of the individual segments comprising the annular segmented support of the present invention.
FIG. 3 is a plan view depicting the individual segments comprising the annular segmented support of the present invention.
FIG. 4 is a plan view depicting the connection between the individual segments of the annular segmented support using an O-ring.
FIG. 5 is a front elevation view in a vertical cross-section depicting the annular segmented support of the present invention.
Figure 6:
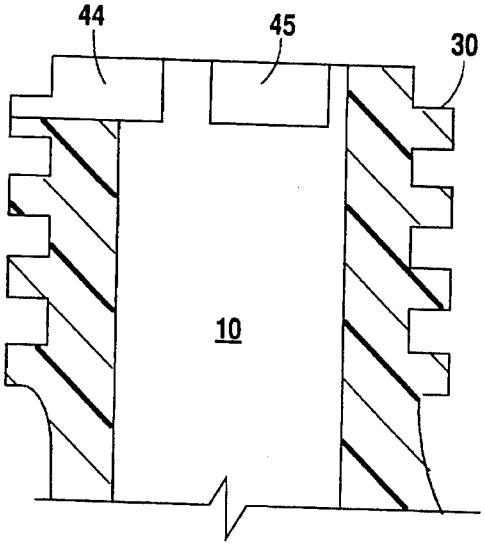
FIG. 6 is a front elevation view in a vertical cross-section depicting the upper end of the carrier tube of the inertial bullet puller.
Figure 7:
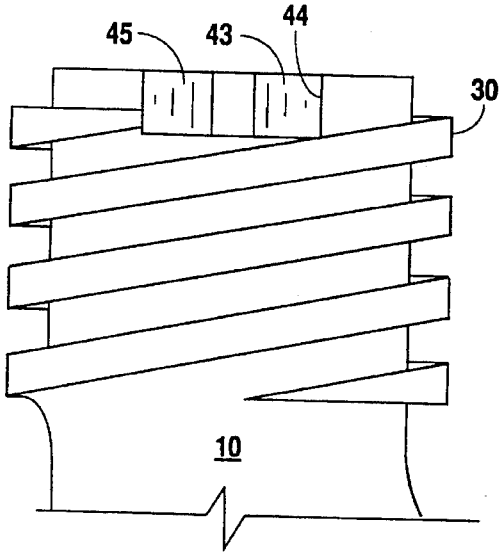
FIG. 7 is a front elevation view depicting the upper end of the carrier tube of the inertial bullet puller.
Figure 8:
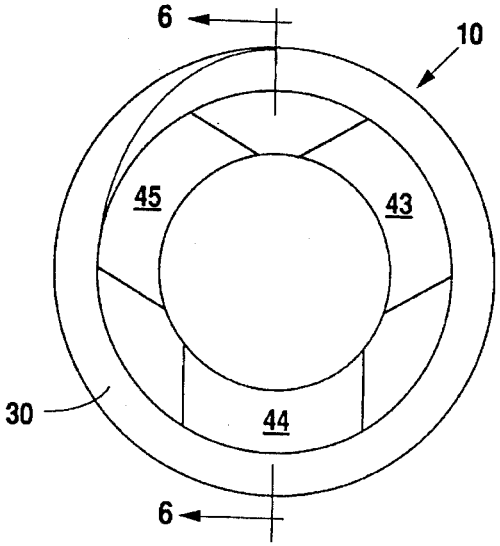
FIG. 8 is a plan view depicting the upper end of the carrier tube of the inertial bullet puller.
Figure 9:
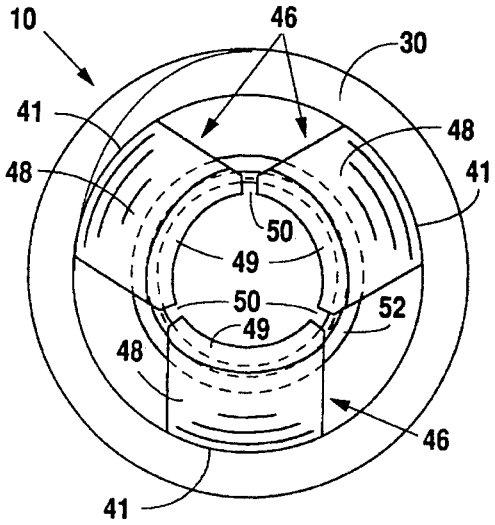
FIG. 9 is a plan view depicting the individual segments comprising the annular segmented support disposed along the upper end of the carrier tube of the inertial bullet puller.

As illustrated in FIGS. 1 and 6–9, inertial bullet puller 5 includes carrier tube 10. Carrier tube 10 is preferably constructed from a generally tubular plastics material member which has an opening at its upper end and a closed lower end 11 providing head portion 12 for striking against a hard surface. Boss 13 on one side of carrier tube 10 provides a connection point for securing carrier tube 10 to a, preferably, aluminum steel shaft 14. Fluted plastics material tube 15 forms a handgrip which is suitably secured to shaft 14. Boss 13, shaft 14, and handgrip 15 together form a handle for carrier tube 10. Shaft 14 may either be a straight shaft or angled up to 15° from the horizontal plane defined by boss 13 in a direction away from closed lower end 11.

The diameter of inner surface 17 of carrier tube 10 is slightly larger than the largest cartridge expected to be used in inertial bullet puller 5. Lower end 18 of inner surface 17 of carrier tube 10 is preferably tapered to provide a surface tangent to arcuate nose 20 of bullet 21 so as to slowly frictionally arrest the downward travel of bullet 21 when it is freed from its casing 22.

Bullet 21 and casing 22, which are crimped thereto at 23 and 24, form part of cartridge 25. Cannelure or annular groove 26 separates the main cylindrical tubular portion of casing 22, which carries the powder charge, from head 27 of cartridge 25 which has a primer/detonator cap (not shown) disposed therein.

The upper end of carrier tube 10 includes external helical screw thread 30 correlative to internal helical screw thread 31 of generally cylindrical cup-shaped screw cap 33. The upper end of carrier tube 10 further includes slots 43–45 cut therein to receive and hold annular segmented support 42 (see FIGS. 6–9). Annular segmented support 42 comprises segments 46 interconnected by O-ring 52. Each of segments 46 fits within a respective one of slots 43–45 to support cartridge 25 within carrier tube 10.

Cap 33 is preferably made of a plastics material similar to that of carrier tube 10. The upper end of cap 33 has a cylindrical opening or bore 34 which is of slightly larger diameter than cylindrical inner surface 17 of carrier tube 10. Cam surface 35 of end 36 of cap 33 is conical and flares toward the open end of cap 33. Preferably the outer periphery of the closed end of cap 33 is provided with bevel 38. The exterior surface of the sides of cap 33 is knurled for easy turning.

Cap 33 provides a means for positively moving segments 46 of annular segmented support 42 radially inward and holding them within slots 43–45 at the upper end of carrier tube 10. When cap 33 is screwed down, cam surface 35 of cap 33 moves each of segments 46 inwardly along slots 43–45 to a position under upper side 100 of cannelure 26 so that they fit snugly against the smallest diameter portion of cannelure 26. Additionally, the inner lower portion of segments 46 engage casing 22 along a portion directly below cannelure 26. Cap 33 retains segments 46 in the above-described position within slots 43–45 on the upper end of carrier tube 10 so that inertial bullet puller 5 may be used.

Referring to FIGS. 2–5, segments 46 of annular segmented support 42 will be described. Although three segments are disclosed, only two segments are necessary, and any number of segments may actually be used. Each of segments 46 comprises an arcuate shell having inner and outer generally cylindrical surfaces 44 and 41, conical inner and near spherical curved outer upper surfaces 47 and 48, and a cylindrical upper edge 49.

Segments 46 are connected together using O-ring 52 which lies within a groove 54 cut into each of inner surfaces 44 of segments 46. With O-ring 52 fitted within each of grooves 54, segments 46 are circumferentially spaced apart as shown at 50 in FIGS. 3–5 and 9. Thus, O-ring 52 not only connects segments 46, but it also provides a restoring force to separate segments 46.

To secure cartridge 25 within segments 46 as shown in FIG. 1, cap 33 is tightened until cam surface 35 of cap 33 engages outer upper surfaces 48 of segments 46 and urges segments 46 inwardly about cartridge 25 along slots 43–45. Segments 46 maintain cartridge 25 at the upper end of carrier tube 10 due to the their edges 49 which snugly engage the smallest diameter part of cannelure 26 and their inner cylindrical surfaces 44 which engage casing 22. After bullet 21 has been separated from casing 22, cap 33 is loosened to remove the force exerted against outer upper surfaces 48 of segments 46 by cam surface 35. Consequently, O-ring 52 urges segments 46 back along slots 43–45 to release the tension applied by segments 46 against casing 22. By forcing segments 46 away from casing 22 along slots 43–45, casing 22 may be easily removed from carrier tube 10, and, further, segments 46 no longer reside over the opening at the upper end of carrier tube 10 which allows bullet 21 to pass from carrier tube 10 without first having to remove cap 33.

In operation, a user grasps handgrip 15, swings inertial bullet puller 5 to impart a high speed to carrier tube 10, and strikes head portion 12 at lower end 11 of carrier tube 10 against a hard surface with carrier tube 10 moving with its axis perpendicular to the surface at the moment of impact. Carrier tube 10 comes to rest and may bounce off of the hard surface. In either instance, the upper end of carrier tube 10 comes to rest slightly later than the lower end as determined by the speed of propagation of the elastic shock wave in the plastic of carrier tube 10. The speed of that shock wave will determine the increment of time during which the momentum of casing 22 is changed from its initial downwardly directed maximum magnitude just prior to impact of carrier tube 10 with the hard surface to a zero or upwardly directed magnitude. That change in momentum is proportional to the force exerted against cartridge 25 which tends to pull casing 22 and bullet 21 apart. It may be considered that when the shock wave reaches annular segmented support 42 the upwardly moving end of carrier tube 10 pushes segments 46 upward relative to cartridge 25, and the upper ends of segments 46 bearing against upper side 100 of cannelure 26 pull casing 22 from bullet 21. The faster the wave moves the faster the upper end of carrier tube 10 moves relative to casing 22, or otherwise expressed, the more quickly casing 22 is brought to rest. Thus, carrier tube 10 is preferably made of a material that transmits elastic waves at a high velocity but has a high impact strength so that it will not shatter. Suitable material may be described as being rigid and tough.

After striking carrier tube head portion 12 against a hard surface, bullet 21 falls free of cartridge casing 22 into lower end 11 of carrier tube 10. Preferably carrier tube 10 is made of transparent material so that this result can be observed, although the rattling of the loose bullet in carrier tube 10 will make this known by sound and shock in any event.

Cap 33 is then loosened sufficiently so that cam surface 35 is spaced axially from top surfaces 48 of segments 46 an adequate distance to permit O-ring 52 to expand segments 46 along slots 43–45. Carrier tube 10 is inverted and casing 22, bullet 21, and the powder are then shaken out of carrier tube 10. Segments 46 expand amply enough to allow even the largest caliber bullets to be removed without first completely detaching cap 33 because O-ring 52 forces them completely from the opening at the upper end of carrier tube 10.

After carrier tube 10 has been emptied, another cartridge may be inserted into the top of carrier tube 10 through cap opening 34. Cap 33 is then tightened until cam surface 35 contacts outer surfaces 48 of segments 46, thereby, closing segments 46 about the cannelure and upper end of the casing. The inertial bullet puller is, thus, ready to remove the bullet from the casing.

It should be apparent to one skilled in the art that the objects of the invention have been realized in the bullet puller embodying the present invention. The annular segmented support is adaptable to a larger range of cannelure diameters and engages the cannelure over a major portion of the circumference thereof. The cap does not need to be removed between each use of the device and is easily rotated the small amount necessary to tighten and free the annular segmented support.

From the foregoing description and illustration of the present invention, it should be apparent that various modifications can be made by reconfigurations or combinations to produce similar results. It is, therefore, the desire of the applicant not to be bound by the description of the present invention contained in this specification, but to be bound only by the claims as appended hereto.

I claim:

1. A bullet puller, comprising:

a carrier tube having an opening at its upper end adapted to receive a cartridge and a closed lower end adapted to be struck against a hard surface, wherein the upper end of said carrier includes a plurality of slots cut therein;

a plurality of annular segments disposed within said plurality of slots at the upper end of said carrier, said plurality of annular segments adapted to engage the cartridge;

cam means removably mounted over said opening at said upper end of said carrier for moving said plurality of annular segments radially inward;

handle means connected at one end to said carrier for imparting motion to said carrier for striking it against the hard surface.

2. The bullet puller according to claim 1 wherein said plurality of annular segments are flexibly connected together.

3. The bullet puller according to claim 2 wherein said plurality of annular segments are flexibly connected together utilizing an O-ring mounted within an inner peripheral groove formed within each of said plurality of annular segments.

4. The bullet puller according to claim 3 wherein said O-ring provides a restoring force to move said plurality of annular segments radially outward when the radially inward urging force produced by said cam means is removed.

5. The bullet puller according to claim 1 wherein said cam means comprises a cap which engages thread means on the upper end of said carrier, said cap having a cam surface on its interior adapted to engage said plurality of annular segments.

6. The bullet puller according to claim 5 wherein said cap further provides means for retaining said plurality of annular segments within said plurality of slots on the upper end of said carrier.

7. The bullet puller according to claim 1 wherein said handle means comprises a metal shaft having a fluted handgrip mounted on the end opposite from said carrier.

8. The bullet puller according to claim 1 wherein said carrier tube comprises a rigid, tough plastics material capable of propagating an elastic shock wave therein at a speed on the order of at least 6000 ft./sec.

* * * * *